US011468815B2

(12) United States Patent
Park et al.

(10) Patent No.: US 11,468,815 B2
(45) Date of Patent: Oct. 11, 2022

(54) DISPLAY DEVICE AND METHOD OF DRIVING DISPLAY DEVICE

(71) Applicant: Samsung Display Co., Ltd., Yongin-Si (KR)

(72) Inventors: Sehyuk Park, Seongnam-si (KR); Hongsoo Kim, Hwaseong-si (KR); Jaekeun Lim, Suwon-si (KR); Jinyoung Roh, Hwaseong-si (KR); Hyojin Lee, Seongnam-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/548,960

(22) Filed: Dec. 13, 2021

(65) Prior Publication Data

US 2022/0230571 A1 Jul. 21, 2022

(30) Foreign Application Priority Data

Jan. 18, 2021 (KR) ..... 10-2021-0006878

(51) Int. Cl.
*G09G 3/20* (2006.01)

(52) U.S. Cl.
CPC ..... *G09G 3/20* (2013.01); *G09G 2310/08* (2013.01); *G09G 2320/0209* (2013.01)

(58) Field of Classification Search
CPC ..... G09G 3/20; G09G 2310/08; G09G 2320/0209
See application file for complete search history.

(56) References Cited

U.S. PATENT DOCUMENTS

2019/0156466 A1* 5/2019 Cho ..... G06F 1/163
2019/0156761 A1* 5/2019 Kim ..... G09G 3/3677

FOREIGN PATENT DOCUMENTS

KR 101341008 B1 12/2013

* cited by examiner

*Primary Examiner* — Sejoon Ahn
(74) *Attorney, Agent, or Firm* — Cantor Colburn LLP

(57) ABSTRACT

A display device includes a display panel including a first display region and a second display region surrounding the first display region, where a first pixel having a first size is disposed in the first display region, and a second pixel having a second size is disposed in the second display region, a gate driver which applies a gate signal to a gate line, a data driver which applies a data voltage to a data line, and a timing controller which controls the gate driver and the data driver. The gate line includes a first gate line connected to both the first pixel and the second pixel, and a second gate line connected only to the second pixel. The data line includes a first data line which does not transmit the data voltage to the second pixel connected to the second gate line, and a second data line which transmits the data voltage to the second pixel connected to the second gate line.

20 Claims, 6 Drawing Sheets

DISPLAY DEVICE AND METHOD OF DRIVING DISPLAY DEVICE

This application claims priority to Korean Patent Application No. 10-2021-0006878, filed on Jan. 18, 2021, and all the benefits accruing therefrom under 35 U.S.C. § 119, the content of which in its entirety is herein incorporated by reference.

BACKGROUND

1. Field

Embodiments of the invention relate to a display device and a method of driving the display device. More specifically, embodiments of the invention relate to a display device configured to extend a display region while maintaining a bezel portion on a display panel, and a method of driving the display device.

2. Description of the Related Art

In general, a display device may include a display panel and a display panel driver. The display panel may include pixels, and may display an image corresponding to input image data by using the pixels. The display panel may be connected to the display panel driver through gate lines and data lines. The display panel driver may include a gate driver that provides a gate signal to the display panel through gate lines, a data driver that provides a data voltage to the display panel through data lines, and a timing controller that controls the gate driver and the data driver.

In a display device, a region occupied by driving circuits included in the display panel driver is typically provided in a bezel portion, and the size of a display region that displays an image on the display panel may be limited due to the bezel portion. However, in such a display device, the driving circuits are essential components in the display device, such that the bezel portion may not be completely removed.

SUMMARY

Recently, a pixel-on-driver ("POD") technology is suggested to extend a display region while maintaining the bezel portion by adding a peripheral display region on a top of the driving circuits. However, in this case, since a separate data voltage is applied to the peripheral display region of the display device, a coupling phenomenon may occur between data voltages, and a vertical crosstalk phenomenon may occur due to electrical interference between the data voltages.

Embodiments of the invention provide a display device that improves display quality by minimizing electrical interference between data voltages applied to a main display region and a peripheral display region, respectively.

Embodiments of the invention also provide a method of driving a display device that improves display quality by minimizing electrical interference between the data voltages.

In an embodiment of a display device according to the invention, a display device includes a display panel including a first display region and a second display region surrounding the first display region, where a first pixel having a first size is disposed in the first display region and second pixels having a second size different from the first size is disposed in the second display region, a gate driver which applies a gate signal to a gate line of the display panel, a data driver which applies a data voltage to a data line of the display panel, and a timing controller which controls the gate driver and the data driver. In such an embodiment, the gate line includes a first gate line connected to both the first pixel and the second pixel, and a second gate line connected only to the second pixel. In such an embodiment, the data line includes a first data line which does not transmit the data voltage to the second pixel connected to the second gate line, and a second data line which transmits the data voltage to the second pixel connected to the second gate line. In such an embodiment, a dummy data voltage is applied to the first data line when the gate signal is applied to the second gate line.

In an embodiment, the display device may further include a data corrector which generates correction data based on input image data and a lookup table.

In an embodiment, the data corrector may include a display region determiner which identifies first image data to be displayed on the first display region and second image data to be displayed on the second display region based on the input image data, the lookup table in which an arrangement information of the first gate line and the second gate line is stored, and a correction data generator which generates the correction data by using the lookup table.

In an embodiment, the timing controller may receive the correction data from the data corrector and generate a dummy data signal based on the correction data.

In an embodiment, the data driver may apply the dummy data voltage, which is generated based on the dummy data signal, to the first data line when the gate signal is applied to the second gate line.

In an embodiment, the second data line may be provided in plural, and the dummy data voltage may be identical to a data voltage applied to a second data line closest to the first data line.

In an embodiment, the dummy data voltage may be identical to the data voltage applied to the first data line in a previous frame.

In an embodiment, the dummy data voltage may have a voltage level corresponding to an intermediate value of the data voltage applied to the second data line.

In an embodiment, the dummy data voltage may have a voltage level between a voltage level of the data voltage corresponding to a black image and a voltage level of the data voltage corresponding to a white image.

In an embodiment, the second display region may include a corner display region extending from a corner of the second display region, and a middle display region between the first display region and the corner display region.

In an embodiment of a method of driving a display device according to the invention, the method includes applying a gate signal to a first gate line connected to both a first pixel and a second pixel, applying the gate signal to a second gate line connected only to the second pixel, and applying a data voltage to a data line. The first pixel may have a first size and is disposed in a first display region. In such an embodiment, the second pixel has a second size different from the first size and is disposed in a second display region surrounding the first display region. In such an embodiment, the data line includes a first data line which does not transmit the data voltage to the second pixel connected to the second gate line, and a second data line which transmits the data voltage to the second pixel connected to the second gate line. In such an embodiment, the applying the data voltage to the data line includes applying a dummy data voltage to the first data line when the gate signal is applied to the second gate line.

In an embodiment, the method may further include generating correction data based on input image data and a lookup table.

In an embodiment, the generating the correction data may include identifying first image data to be displayed on the first display region and second image data to be displayed on the second display region based on the input image data, and generating the correction data by using the lookup table in which arrangement information of the first gate line and the second gate line is stored.

In an embodiment, the method may further include generating a dummy data signal based on the correction data.

In an embodiment, the applying the data voltage to the data line may further include generating the dummy data voltage based on the dummy data signal.

In an embodiment, the second data line may be provided in plural, and the dummy data voltage may be identical to a data voltage applied to a second data line closest to the first data line.

In an embodiment, the dummy data voltage may be identical to the data voltage applied to the first data line in a previous frame.

In an embodiment, the dummy data voltage may have a voltage level corresponding to an intermediate value of the data voltage applied to the second data line.

In an embodiment, the dummy data voltage may have a voltage level between a voltage level of the data voltage corresponding to a black image and a voltage level of the data voltage corresponding to a white image.

In an embodiment, the second display region may include a corner display region extending from a corner of the second display region, and a middle display region between the first display region and the corner display region.

In embodiments of the invention, the display device may apply a dummy data voltage to a first data line to minimize electrical interference between data voltages.

Accordingly, in such embodiments, the display device may reduce the coupling phenomenon between the data voltages and prevent the vertical crosstalk phenomenon caused by the electrical interference. As a result, the display device may improve the reliability of display quality by minimizing deterioration in quality of an image displayed on the display panel.

DETAILED DESCRIPTION

Figure 1:
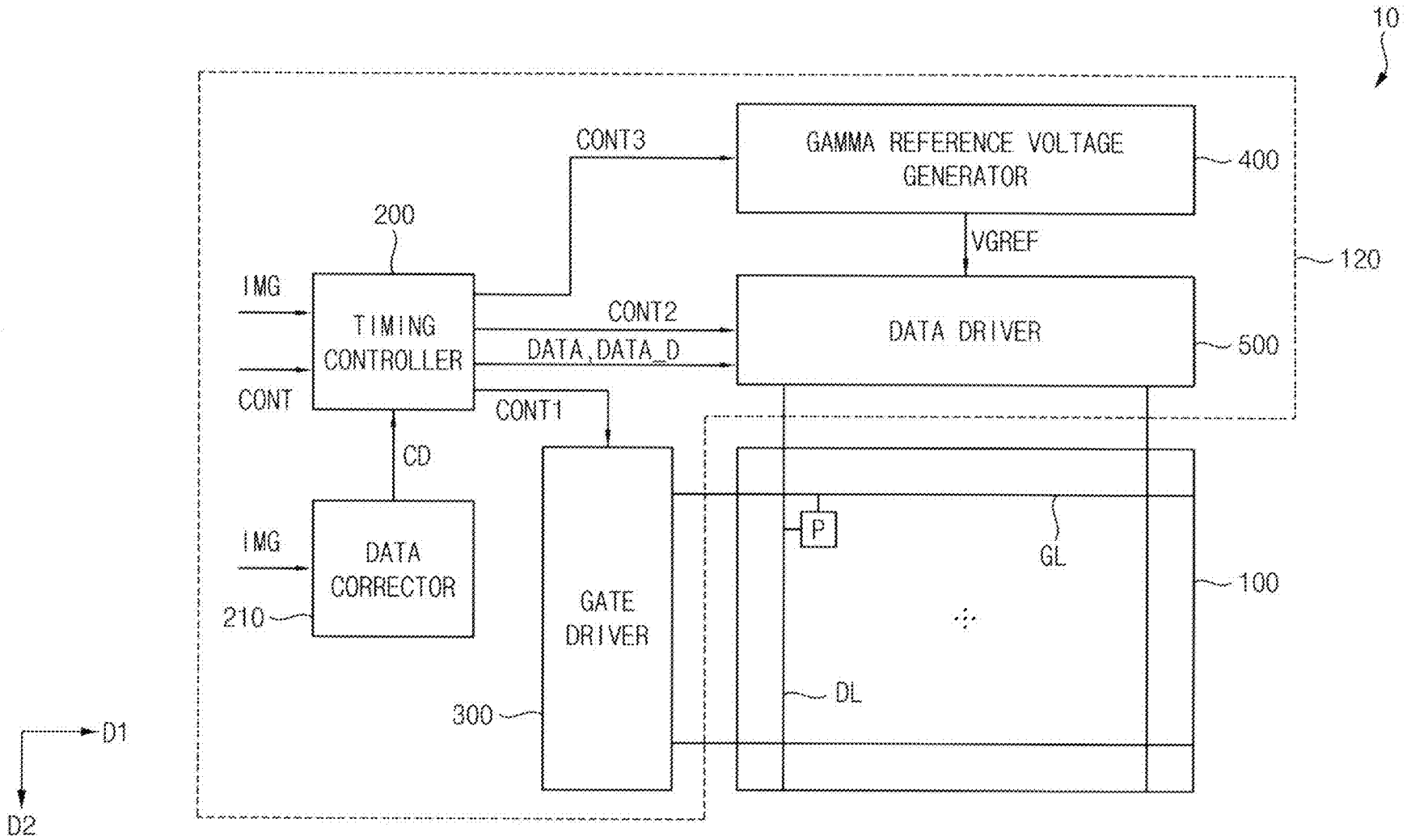
FIG. 1 is a block diagram illustrating a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

Figure 2:
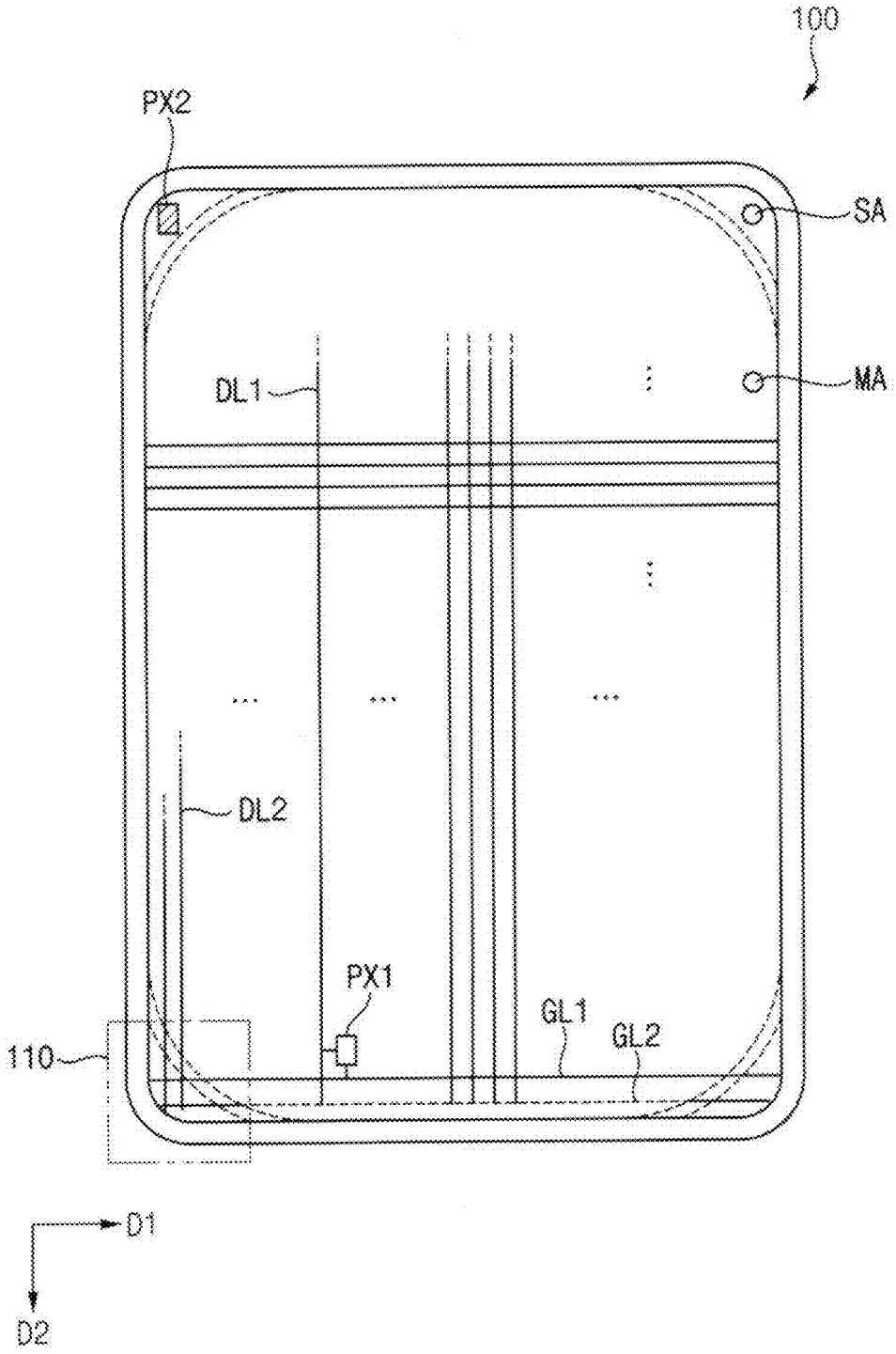
FIG. 2 is a diagram illustrating an embodiment of a display panel included in the display device of FIG. 1.
Figure 3:
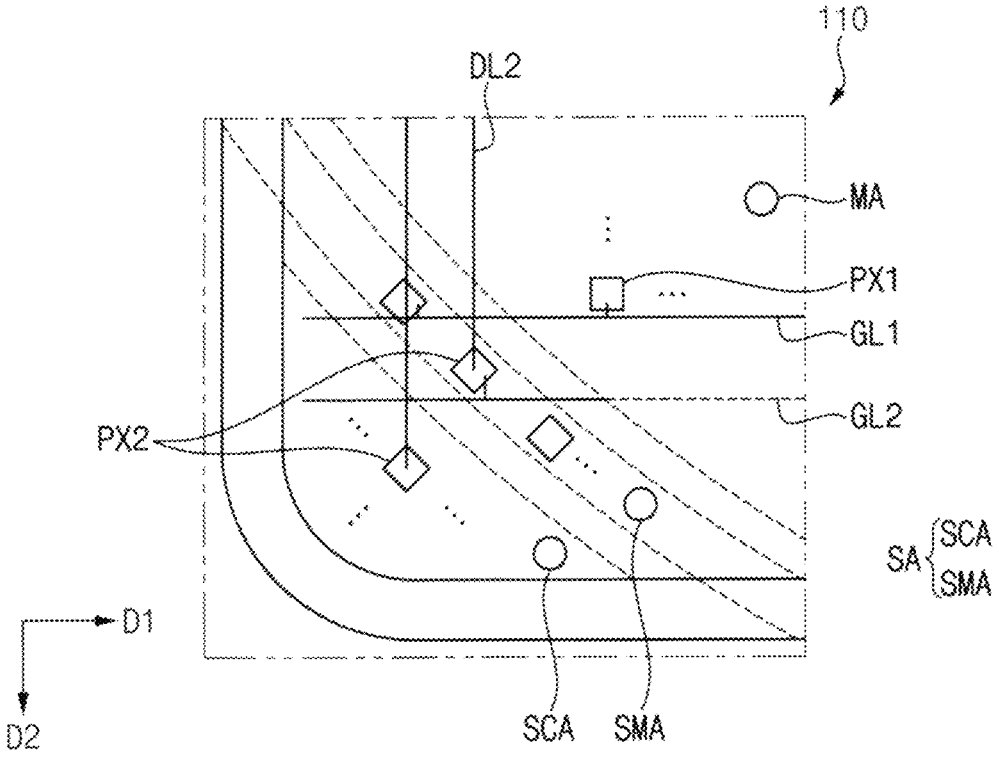
FIG. 3 is an enlarged diagram of one corner portion of the display panel of FIG. 2.

FIG. 1 is a block diagram illustrating a display device 10 according to an embodiment, FIG. 2 is a diagram illustrating an embodiment of a display panel 100 included in the display device 10 of FIG. 1, and FIG. 3 is an enlarged view of one corner portion 110 of the display panel 100 of FIG. 2.

Referring to FIGS. 1 to 3, an embodiment of the display device 10 may include a display panel 100 and a display panel driver 120. The display panel driver 120 may include a timing controller 200, a data corrector 210, a gate driver 300, a gamma reference voltage generator 400, and a data driver 500.

The display panel 100 may include a display portion for displaying an image and a peripheral portion disposed adjacent to the display portion.

The display panel 100 may include pixels P to display an image corresponding to input image data IMG. The gate lines GL may extend in the first direction D1, and the data lines DL may extend in the second direction D2 crossing the first direction D1.

In an embodiment, as shown in FIG. 2, the display portion for displaying the image of the display panel 100 may include a main display region MA and a peripheral display region SA. The main display region MA may be surrounded by the peripheral display region SA. First pixels PX1 having a first size may be disposed in the main display region MA, and second pixels PX2 having a second size different from the first size may be disposed in the peripheral display region SA. In such an embodiment, the number of pixels per unit inch ("ppi") of the peripheral display region SA may be different from the number of pixels per unit inch of the main display region MA.

At least one panel driving circuit may be disposed in a lower circuit layer of the peripheral display region SA. The panel driving circuit disposed in the lower circuit layer of the peripheral display region SA may include the timing controller 200. The panel driving circuit disposed in the lower circuit layer of the peripheral display region SA may include the gate driver 300. The panel driving circuit disposed in the lower circuit layer of the peripheral display region SA may include the data driver 500. The panel driving circuit disposed in the lower circuit layer of the peripheral display region SA may include the gamma reference voltage generator 400. Accordingly, in such an embodiment, the display panel 100 may provide a wider display region than a conventional display panel by displaying an image on the peripheral display region SA while maintaining the bezel portion.

The timing controller 200 may receive input image data IMG and an input control signal CONT from an external device (not shown). In one embodiment, for example, the input image data IMG received from the external device may include red image data, green image data, and blue image data. According to an embodiment, the input image data IMG may further include white image data. In one alternative embodiment, for example, the input image data IMG may include magenta image data, yellow image data, and cyan image data. In an embodiment, the input control signal CONT received from the external device may include a master clock signal, a data enable signal, a vertical synchronization signal, a horizontal synchronization signal, and the like.

In an embodiment, the timing controller 200 may generate a first control signal CONT1, a second control signal CONT2, a third control signal CONT3, and a data signal DATA based on the input image data IMG and the input control signal CONT. In such an embodiment, the timing controller 200 may further generate a dummy data signal DATA_D.

The timing controller 200 may generate the first control signal CONT1 for controlling the operation of the gate driver 300 based on the input control signal CONT and output the first control signal CONT1 to the gate driver 300. The first control signal CONT1 may include a vertical start signal and a gate clock signal.

The timing controller 200 may generate the second control signal CONT2 for controlling the operation of the data driver 500 based on the input control signal CONT and output the second control signal CONT2 to the data driver 500. The second control signal CONT2 may include a horizontal start signal and a load signal.

In an embodiment, the timing controller 200 may generate the data signal DATA based on the input image data IMG. In such an embodiment, the timing controller 200 may generate the dummy data signal DATA_D based on the correction data CD. The timing controller 200 may output the data signal DATA and the dummy data signal DATA_D to the data driver 500.

The timing controller 200 may generate the third control signal CONT3 for controlling the operation of the gamma reference voltage generator 400 based on the input control signal CONT. The timing controller 200 may output the third control signal CONT3 to the gamma reference voltage generator 400.

Figure 4:
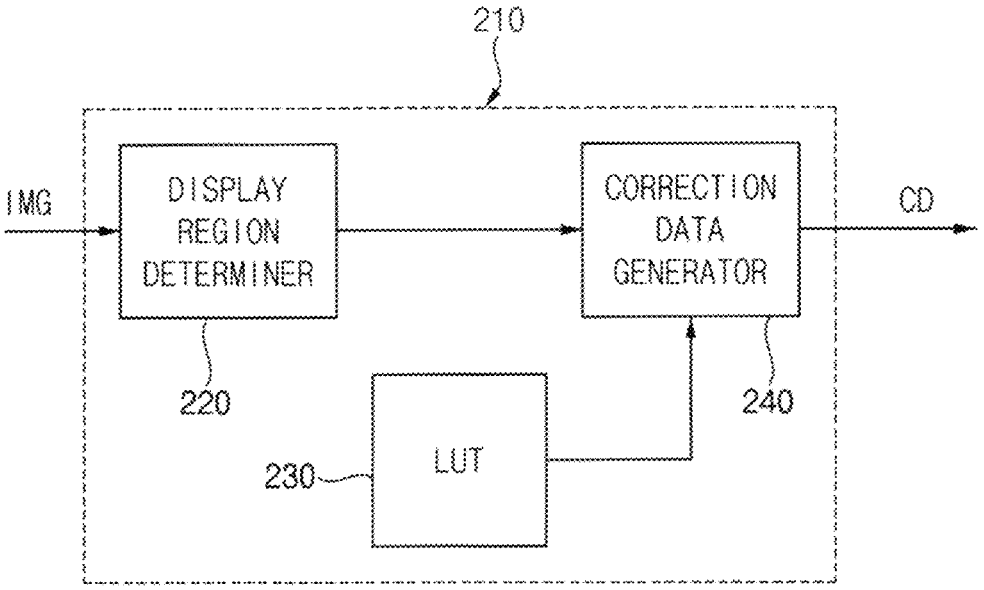
FIG. 4 is a block diagram illustrating an embodiment of a data corrector included in the display device of FIG. 1.

The data corrector 210 may generate correction data CD based on the input image data IMG and a lookup table 230 (shown in FIG. 4). The data corrector 210 may receive input image data IMG and identify image data to be displayed on the display region. The data corrector 210 may generate correction data CD for generating a dummy data voltage by using arrangement information of gate lines GL previously stored in the lookup table 230. The data corrector 210 may transmit the correction data CD to the timing controller 200. In one embodiment, for example, the data corrector 210 may be disposed outside the timing controller 200 to transmit or receive a signal in association with the timing controller 200 as shown in 1. In one alternative embodiment, for example, the data corrector 210 may be disposed inside the timing controller 200 as a part of the timing controller 200, but not being limited thereto.

The gate driver 300 may generate gate signals for driving the gate lines GL in response to the first control signal CONT1 received from the timing controller 200. The gate driver 300 may output the gate signals to the gate lines GL. In one embodiment, for example, the gate driver 300 may sequentially output the gate signals to the gate lines GL. In one embodiment, for example, the gate driver 300 may be mounted on the peripheral portion of the display panel 100, but not being limited thereto.

The gamma reference voltage generator 400 may generate a gamma reference voltage VGREF in response to the third control signal CONT3 received from the timing controller 200. The gamma reference voltage generator 400 may provide the gamma reference voltage VGREF to the data driver 500. The gamma reference voltage VGREF provided to the data driver 500 may have a value corresponding to each data signal DATA. In one embodiment, for example, the gamma reference voltage generator 400 may be disposed inside the timing controller 200 or the data driver 500, but not being limited thereto.

In an embodiment, the data driver 500 may receive the second control signal CONT2, the data signal DATA, and the dummy data signal DATA_D from the timing controller 200, and may receive the gamma reference voltage VGREF from the gamma reference voltage generator 400. The data driver 500 may convert the digital data signal DATA into an analog data voltage by using the gamma reference voltage VGREF. In such an embodiment, the data driver 500 may convert the digital dummy data signal DATA_D into an analog dummy data voltage by using the gamma reference voltage VGREF. The data driver 500 may output the data voltage to the data lines DL.

Referring to FIGS. 2 and 3, the display portion for displaying the image of the display panel 100 may include the peripheral display region SA and the main display region MA. The main display region MA may be surrounded by the peripheral display region SA. According to an embodiment, the first image may be displayed on the main display region MA and the second image may be displayed on the peripheral display region SA. At least one panel driving circuit may be disposed in the lower circuit layer of the peripheral display region SA. Accordingly, in such an embodiment, the display panel 100 may provide a wider display region than a conventional display panel by displaying an image on the peripheral display region SA while maintaining the bezel portion.

In an embodiment, first pixels PX1 having a first size may be disposed in the main display region MA. In such an embodiment, second pixels PX2 having a second size may be disposed in the peripheral display region SA. In an embodiment, the first size of the first pixels PX1 may be smaller than the second size of the second pixels PX2. In such an embodiment, the number of pixels per unit inch of the main display region MA may be greater than the number of pixels per unit inch of the peripheral display region SA. In such an embodiment, the second size of the second pixels PX2 may be larger than the first size of the first pixels PX1. In such an embodiment, the number of pixels per unit inch of the peripheral display region SA may be smaller than the number of pixels per unit inch of the main display region MA. In an embodiment, as shown in FIG. 3, the peripheral display region SA may include a corner display region SCA extending from a corner of the peripheral display region SA and a middle display region SMA between the main display region MA and the corner display region SCA. The corner display region SCA and the middle display region SMA may be formed through different processes from each other. Each of the corner display region SCA and the middle display region SMA may include second pixels PX2.

In an embodiment, the gate line GL applied to the display panel 100 may include a first gate line GL1 connected to both the first pixel PX1 and the second pixel PX2 and a second gate line GL2 connected only to the second pixel PX2. In such an embodiment, the gate line GL may include the first gate line GL1 electrically connected to both the main display region MA and the peripheral display region SA. The first gate line GL1 may transmit a gate signal to both the first pixel PX1 and the second pixel PX2. The gate line GL may include the second gate line GL2 electrically connected only to the peripheral display region SA. The second gate line GL2 may transmit the gate signal only to the second pixel PX2. In one embodiment, for example, the second gate line GL2 may be connected to the second pixel PX2 in the corner display region SCA of the peripheral display region SA. In one alternative embodiment, for example, the second gate line GL2 may be connected to the second pixel PX2 in the middle display region SMA in the peripheral display region SA.

The data line DL of the display panel 100 may be identified based on whether to transmit a data voltage to the second pixel PX2 connected to the second gate line GL2. In an embodiment, the data line DL may include a first data line DL1 that does not transmit the data voltage to the second pixel PX2 connected to the second gate line GL2 and a second data line DL2 that transmits the data voltage to the second pixel PX2 connected to the second gate line GL2. In an embodiment, as shown in FIG. 2, the first data line DL1 may not transmit the data voltage to the second pixel PX2 connected to the second gate line GL2. In such an embodiment, the second data line DL2 may transmit the data voltage to the second pixel PX2 connected to the second gate line GL2. In an embodiment, when the gate signal is applied to the second gate line GL2, the second data line DL2 may transmit a valid data voltage to the second pixel PX2. In such an embodiment, when the gate signal is applied to the second gate line GL2, since there is no target pixel to transmit the data voltage, the first data line DL1 does not transmit a valid data voltage to the pixel regardless of the applied data voltage.

In a case where the data driver 500 applies a data voltage corresponding to a black image to the first data line DL1, the data voltage corresponding to the black image and applied to the first data line DL1 may be coupled with a valid data voltage applied to the first data line DL1, so that electrical interference may occur. In one embodiment, for example, the electrical interference may be a vertical cross talk. Such an electrical interference may degrade the image quality of an image displayed on the display panel 100 and may cause defects in display quality. In an embodiment of the invention, the display device 10 may apply the dummy data voltage capable of minimizing the electrical interference to the first data line DL1 when the gate signal is applied to the second gate line GL2 to thereby effectively prevent the defects in display quality due to the electrical interference.

FIG. 4 is a block diagram illustrating an embodiment of the data corrector 210 included in the display device 10 of FIG. 1.

Referring to FIGS. 1 to 4, an embodiment of the data corrector 210 may generate the correction data CD based on the input image data IMG and the lookup table (LUT in FIG. 4) 230. The data corrector 210 may receive input image data IMG and identify the display region. The data corrector 210 may generate the correction data CD for generating a dummy data voltage by using arrangement information of gate lines GL previously stored in the lookup table 230. The data corrector 210 may transmit the correction data CD to the timing controller 200. In an embodiment, the data corrector 210 may include a display region determiner 220, a lookup table 230, and a correction data generator 240, to perform such operations.

In an embodiment, the display region determiner 220 may identify the first image data to be displayed on the main display region MA and the second image data to be displayed on the peripheral display region SA based on the input image data IMG. The display region determiner 220 may identify the input image data IMG into first image data and second image data by using a data sheet input in a manufacturing process of the display device 10. The display region determiner 220 may transmit the first image data and the second image data to the correction data generator 240. The lookup table 230 may store arrangement information of the first and second gate lines GL1 and GL2. In an embodiment, the lookup table 230 may store the arrangement information of the first gate line GL1 connected to both the first pixel PX1 and the second pixel PX2 and the second gate line GL2 connected only to the second pixel PX2 and transmit the arrangement information of the gate lines GL to the correction data generator 240. The correction data generator 240 may generate the correction data CD by using the lookup table 230. In an embodiment, the correction data generator 240 may receive the first image data to be displayed on the main display region MA and the second image data to be displayed on the peripheral display region SA from the display region determiner 220. In such an embodiment, the correction data generator 240 may receive the arrangement information of the first gate line GL1 and the second gate line GL2 from the lookup table 230. The correction data generator 240 may generate the correction data CD for determining a dummy data voltage applied to the first data line DL1. In one embodiment, for example, the correction data CD may determine the voltage level of the dummy data voltage applied to the first data line DL1 when the gate signal is applied to the second gate line GL2. The correction data generator 240 may identify second image data to be displayed on the second pixel PX2 connected to the second gate line GL2 from among the second image data to be displayed on the peripheral display region SA. The correction data CD may correct the second image data to determine the voltage level of the dummy data voltage in a way that electrical interference between the data voltages is effectively reduced or substantially minimized.

In an embodiment, referring back to FIG. 1, the data corrector 210 may generate the correction data CD and transmit the correction data CD to the timing controller 200. The timing controller 200 may receive the correction data CD from the data corrector 210. The timing controller 200 may generate the dummy data signal DATA_D based on the correction data CD. The timing controller 200 may transmit the data signal DATA and the dummy data signal DATA_D to the data driver 500. The data driver 500 may receive the data signal DATA and the dummy data signal DATA_D from the timing controller 200. The data driver 500 may convert the digital data signal DATA into an analog data voltage by using the gamma reference voltage VGREF, and the data driver 500 may convert the digital dummy data signal DATA_D into an analog dummy data voltage by using the gamma reference voltage VGREF. The data driver 500 may output the data voltage to the data lines DL.

The gate line GL applied to the display panel 100 may include the first gate line GL1 connected to both the first pixel PX1 and the second pixel PX2 and the second gate line GL2 connected only to the second pixel PX2. In such an embodiment, the gate line GL may include the first gate line GL1 electrically connected to both the main display region MA and the peripheral display region SA. The first gate line GL1 may transmit the gate signal to both the first pixel PX1 and the second pixel PX2. The gate line GL may include the second gate line GL2 electrically connected only to the peripheral display region SA. The second gate line GL2 may transmit the gate signal only to the second pixel PX2. In one embodiment, for example, the second gate line GL2 may be connected to the second pixel PX2 in the corner display region SCA in the peripheral display region SA. In one alternative embodiment, for example, the second gate line GL2 may be connected to the second pixel PX2 in the middle display region SMA in the peripheral display region SA. In an embodiment, the data line DL of the display panel 100 may be identified based on whether to transmit the data voltage to the second pixel PX2 connected to the second gate line GL2. In an embodiment, the data line DL may include the first data line DL1 that does not transmit the data voltage to the second pixel PX2 connected to the second gate line GL2 and the second data line DL2 that transmits the data voltage to the second pixel PX2 connected to the second gate line GL2. In such an embodiment, when the gate signal is applied to the second gate line GL2, the data driver 500 may apply the dummy data voltage generated based on the dummy data signal DATA_D to the first data line DL1. In one embodiment, for example, the dummy data voltage may have the voltage level except for (or different from) a voltage level of a data voltage corresponding to a black image. When the dummy data voltage has such a voltage level, the display device 10 may reduce a coupling phenomenon between data voltages and prevent a vertical crosstalk phenomenon caused by the electrical interference.

Figure 5:
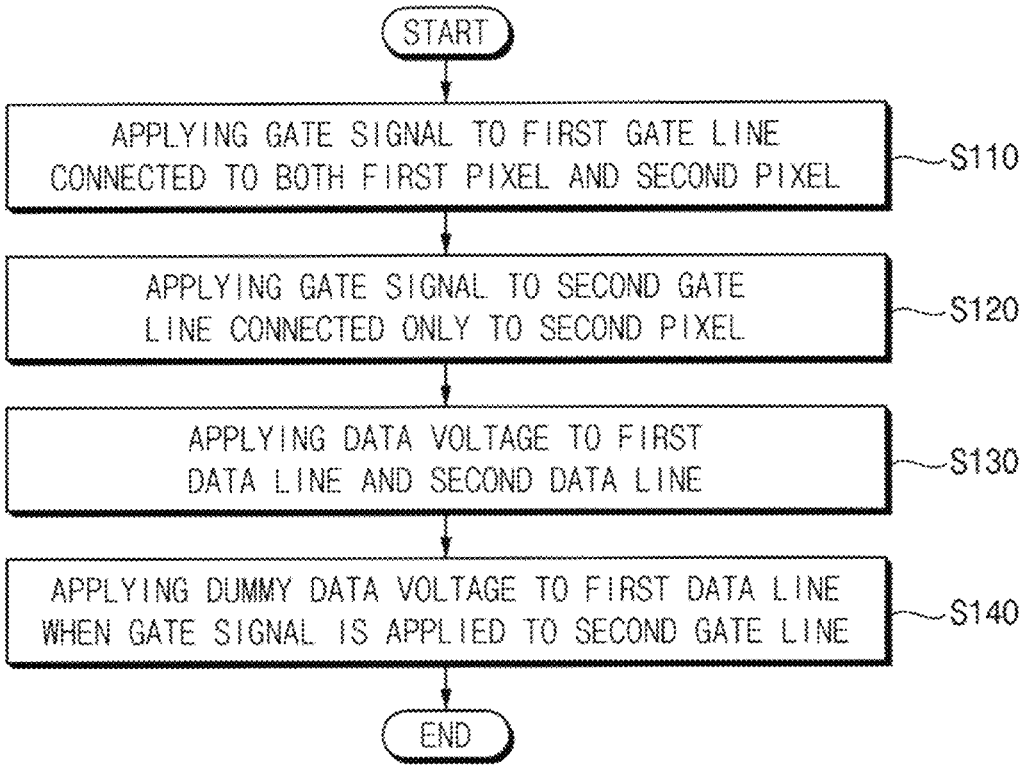
FIG. 5 is a flowchart illustrating an operation of the display device of FIG. 1 according to an embodiment.

FIG. 5 is a flowchart illustrating an operation of the display device 10 of FIG. 1 according to an embodiment.

Referring to FIG. 5, an embodiment of the display device 10 according to the invention may apply the gate signal to the first gate line GL1 connected to both the first pixel PX1 and the second pixel PX2 (S110), apply the gate signal to the second gate line GL2 connected only to the second pixel PX2 (S120), and apply the data voltage to the first data line DL1 and the second data line DL2 (S130). When the gate signal is applied to the second gate line GL2, the display device 10 may apply the dummy data voltage except for (or different from) the data voltage corresponding to the black image to the first data line DL1 (S140).

In an embodiment, the display device 10 may apply the gate signal to the first gate line GL1 connected to both the first pixel PX1 and the second pixel PX2 (S110), and apply the gate signal to the second gate line GL2 connected only to the second pixel PX2 (S120). In such an embodiment, the gate line GL may include the first gate line GL1 electrically connected to both the main display region MA and the peripheral display region SA. The first gate line GL1 may transmit the gate signal to both the first pixel PX1 and the second pixel PX2. The gate line GL may include the second gate line GL2 electrically connected only to the peripheral display region SA. The second gate line GL2 may transmit the gate signal only to the second pixel PX2. In one embodiment, for example, the second gate line GL2 may be connected to the second pixel PX2 in the corner display region SCA in the peripheral display region SA. In one alternative embodiment, for example, the second gate line GL2 may be connected to the second pixel PX2 in the middle display region SMA in the peripheral display region SA.

In an embodiment, the display device 10 may apply the data voltage to the first data line DL1 and the second data line DL2 (S130). In such an embodiment, the data line DL may include the first data line DL1 that does not transmit the data voltage to the second pixel PX2 connected to the second gate line GL2 and the second data line DL2 that transmits the data voltage to the second pixel PX2 connected to the second gate line GL2. The first data line DL1 may not transmit the data voltage to the second pixel PX2 connected to the second gate line GL2. The second data line DL2 may transmit the data voltage to the second pixel PX2 connected to the second gate line GL2. When the gate signal is applied to the second gate line GL2, the second data line DL2 may transmit a valid data voltage to the second pixel PX2. In such an embodiment, when the gate signal is applied to the second gate line GL2, since there is no target pixel to transmit the data voltage, the first data line DL1 does not transmit a valid data voltage to the pixel regardless of the applied data voltage.

In an embodiment, when the gate signal is applied to the second gate line GL2, the display device 10 may apply the dummy data voltage except for (or different from) the data voltage corresponding to the black image to the first data line DL1 (S140). When the data voltage corresponding to the black image is applied to the first data line DL1, the data voltage may be coupled with the valid data voltage applied to the first data line DL1 so that the electrical interference may occur. Such an electrical interference may degrade the image quality of an image displayed on the display panel 100 and may cause defects in display quality. In an embodiment of the invention, the display device 10 may apply the dummy data voltage capable of minimizing the electrical interference to the first data line DL1, when the gate signal is applied to the second gate line GL2, to prevent such defects in display quality caused by the electrical interference. In one embodiment, for example, the dummy data voltage may be the same as the data voltage applied to the second data line DL2 closest to the first data line DL1. In one alternative embodiment, for example, the dummy data voltage may be the same as the data voltage applied to the first data line DL1 in a previous frame. In one alternative embodiment, for example, the dummy data voltage may have the voltage level corresponding to an intermediate value of the data voltage applied to the second data line DL2. However, the invention is not limited to such a dummy data voltage described above. In one alternative embodiment, for example, the dummy data voltage may be set to have a voltage level between a voltage level of the data voltage corresponding to the black image and a voltage level of the data voltage corresponding to the white image. In such an embodiment, when the dummy data voltage is changed, the display device 10 may reduce the coupling phenomenon between data voltages and prevent the vertical crosstalk phenomenon caused by the electrical interference.

Figure 6:
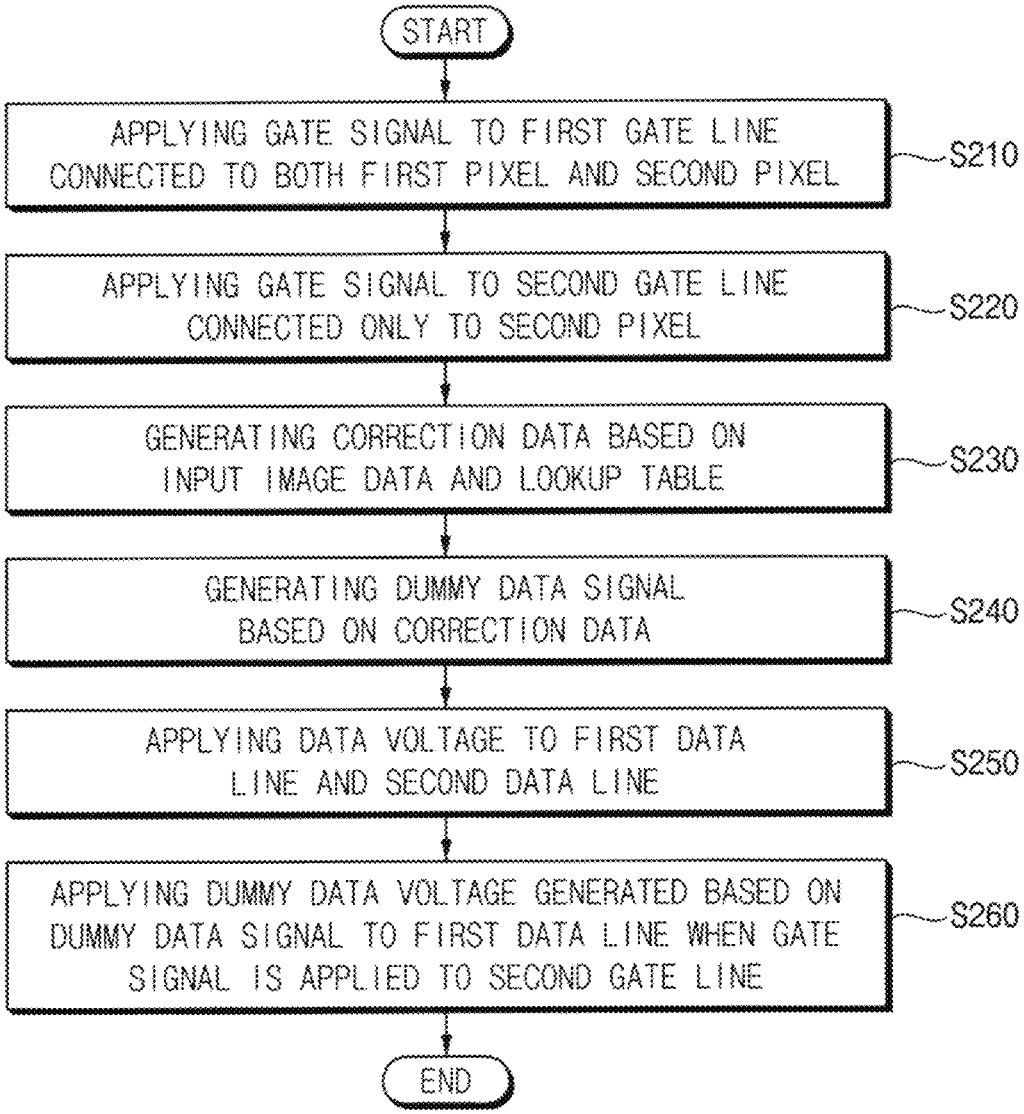
FIG. 6 is a flowchart illustrating an operation of the display device of FIG. 1 according to an alternative embodiment.

FIG. 6 is a flowchart illustrating an operation of the display device 10 of FIG. 1 according to an alternative embodiment.

Referring to FIGS. 1 to 6, an embodiment of the display device 10 according to the invention may apply the gate signal to the first gate line GL1 connected to both the first pixel PX1 and the second pixel PX2 (S210), and apply the gate signal to the second gate line GL2 connected only to the second pixel PX2 (S220). In such an embodiment, the display device 10 may generate the correction data CD based on the input image data IMG and the lookup table 230 (S230), generate the dummy data signal DATA_D based on the correction data CD (S240), and apply the data voltage to the first data line DL1 and the second data line DL2 (S250). When the gate signal is applied to the second gate line GL2, the display device 10 may apply the dummy data voltage except for (or different from) the data voltage corresponding to the black image to the first data line DL1 (S260).

In an embodiment, the display device 10 may apply the gate signal to the first gate line GL1 connected to both the first pixel PX1 and the second pixel PX2 (S210), and apply the gate signal to the second gate line GL2 connected only to the second pixel PX2 (S220). In such an embodiment, the gate driver 300 may generate the gate signals for driving the gate lines GL in response to the first control signal CONT1 received from the timing controller 200. The gate driver 300 may output the gate signals to the gate lines GL. In one embodiment, for example, the gate driver 300 may sequentially output the gate signals to the gate lines GL. In such an embodiment, the gate line GL may include the first gate line GL1 electrically connected to both the main display region MA and the peripheral display region SA. The first gate line GL1 may transmit the gate signal to both the first pixel PX1 and the second pixel PX2. The gate line GL may include the second gate line GL2 electrically connected only to the peripheral display region SA. The second gate line GL2 may transmit the gate signal only to the second pixel PX2. In one embodiment, for example, the second gate line GL2 may be connected to the second pixel PX2 in the corner display region SCA in the peripheral display region SA. In one alternative embodiment, for example, the second gate line GL2 may be connected to the second pixel PX2 in the middle display region SMA in the peripheral display region SA. In an embodiment, the data line DL of the display panel 100 may be identified based on whether to transmit the data voltage to the second pixel PX2 connected to the second gate line GL2. In such an embodiment, the data line DL may include the first data line DL1 that does not transmit the data voltage to the second pixel PX2 connected to the second gate line GL2 and the second data line DL2 that transmits the data voltage to the second pixel PX2 connected to the second gate line GL2.

In an embodiment, the display device 10 may generate the correction data CD based on the input image data IMG and the lookup table 230 (S230), generate the dummy data signal DATA_D based on the correction data CD (S240), and apply the data voltage to the first data line DL1 and the second data line DL2 (S250). In such an embodiment, the data corrector 210 may generate the correction data CD based on the input image data IMG and the lookup table (LUT in FIG. 4) 230. The data corrector 210 may receive the input image data IMG and identify the display region. The data corrector 210 may generate the correction data CD for generating the dummy data voltage by using the arrangement information of the gate lines GL previously stored in the lookup table 230. The data corrector 210 may transmit the correction data CD to the timing controller 200. In such an embodiment, the data corrector 210 may include the display region determiner 220, the lookup table 230, and the correction data generator 240 to perform such an operation. The display region determiner 220 may identify the first image data to be displayed on the main display region MA and the second image data to be displayed on the peripheral display region SA based on the input image data IMG. The display region determiner 220 may identify the input image data IMG into the first image data and the second image data by using a data sheet input in a manufacturing process of the display device 10. The display region determiner 220 may transmit the first image data and the second image data to the correction data generator 240. The lookup table 230 may store the arrangement information of the first gate line GL1 and the second gate line GL2. In such an embodiment, the lookup table 230 may include the arrangement information of the first gate line GL1 connected to both the first pixel PX1 and the second pixel PX2 and the second gate line GL2 connected only to the second pixel PX2 and transmit the arrangement information of the gate lines GL to the correction data generator 240. The correction data generator 240 may generate the correction data CD by using the lookup table 230. In such an embodiment, the correction data generator 240 may receive the first image data to be displayed on the main display region MA and the second image data to be displayed on the peripheral display region SA from the display region determiner 220. In an embodiment, the correction data generator 240 may receive the arrangement information of the first gate line GL1 and the second gate line GL2 from the lookup table 230. The correction data generator 240 may generate the correction data CD for determining the dummy data voltage applied to the first data line DL1. In one embodiment, for example, the correction data CD may determine the voltage level of the dummy data voltage applied to the first data line DL1 when the gate signal is applied to the second gate line GL2. The correction data generator 240 may identify the second image data to be displayed on the second pixel PX2 connected to the second gate line GL2 from among the second image data to be displayed on the peripheral display region SA. The correction data CD may correct the second image data to determine the voltage level of the dummy data voltage that minimizes the electrical interference between the data voltages.

In an embodiment, the data corrector 210 may generate the correction data CD and transmit the correction data CD to the timing controller 200. The timing controller 200 may receive the correction data CD from the data corrector 210. The timing controller 200 may generate the dummy data signal DATA_D based on the correction data CD. The timing controller 200 may transmit the data signal DATA and the dummy data signal DATA_D to the data driver 500. The data driver 500 may receive the data signal DATA and the dummy data signal DATA_D from the timing controller 200. The data driver 500 may convert the digital data signal DATA into an analog data voltage using the gamma reference voltage VGREF. In such an embodiment, the data driver 500 may convert the digital dummy data signal DATA_D into an analog dummy data voltage by using the gamma reference voltage VGREF. The data driver 500 may output the data voltage to the data lines DL. In such an embodiment, when the gate signal is applied to the second gate line GL2, the data driver 500 may apply the dummy data voltage generated based on the dummy data signal DATA_D to the first data line DL1. In one embodiment, for example, the dummy data voltage may have the voltage level except for (or different from) the voltage level of the data voltage corresponding to the black image.

In an embodiment, when the gate signal is applied to the second gate line GL2, the display device 10 may apply the dummy data voltage except for (or different from) the data voltage corresponding to the black image to the first data line DL1 (S260). In such an embodiment, the display device 10 may apply the dummy data voltage capable of minimizing the electrical interference to the first data line DL1, when the gate signal is applied to the second gate line GL2, to prevent the defects in display quality due to the electrical interference.

In such an embodiment, the dummy data voltage may be generated based on the dummy data signal DATA_D generated from the timing controller 200. In one embodiment, for example, the dummy data voltage may be the same as the data voltage applied to the second data line DL2 closest to the first data line DL1. In one embodiment, for example, the dummy data voltage may be the same as the data voltage applied to the first data line DL1 in a previous frame. In one alternative embodiment, for example, the dummy data voltage may have the voltage level corresponding to an intermediate value of the data voltage applied to the second data line DL2. However, the invention is not limited to such a dummy data voltage described above. In one alternative embodiment, for example, the dummy data voltage may be set between the data voltage corresponding to the black image and the data voltage corresponding to the white image.

In an embodiment, as described above, the display device 10 may reduce the coupling phenomenon between data voltages and prevent the vertical crosstalk phenomenon caused by the electrical interference. As a result, the display device 10 may improve the reliability of display quality by minimizing defects in image quality of an image displayed on the display panel 100.

Figure 7:
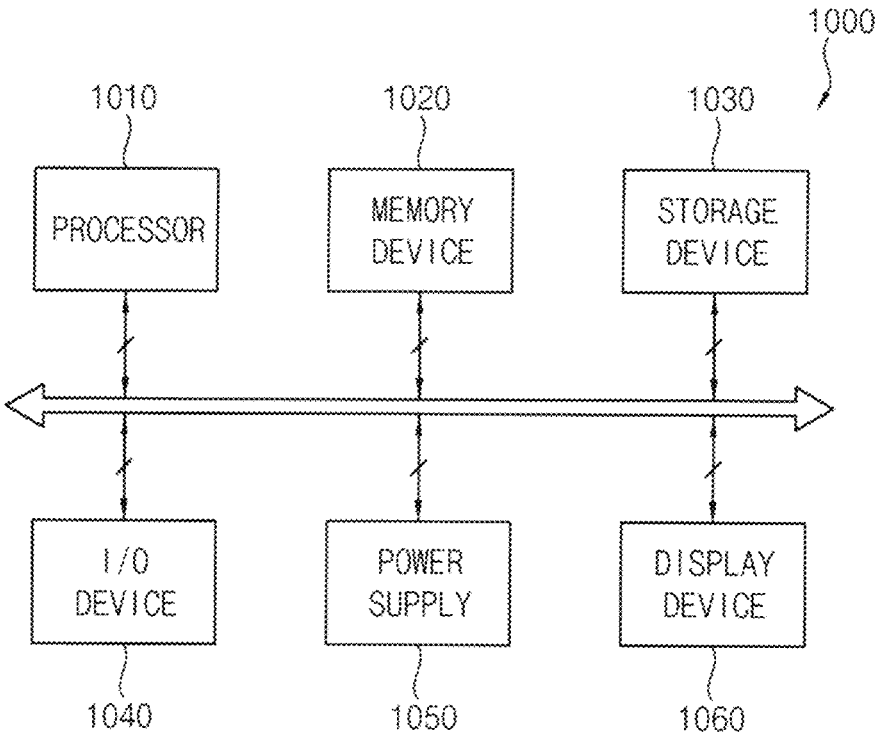
FIG. 7 is a block diagram illustrating an electronic device according to an embodiment of the invention.
Figure 8:
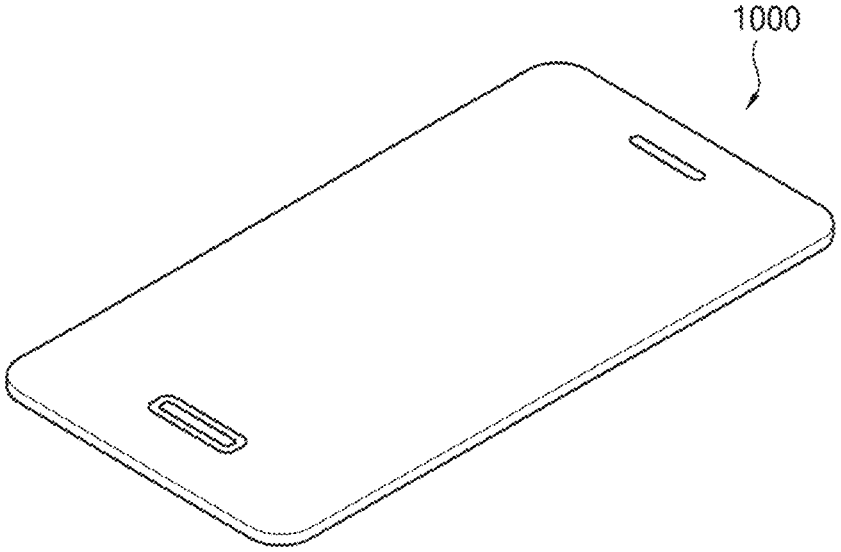
FIG. 8 is a diagram illustrating an embodiment in which the electronic device of FIG. 7 is implemented as a smart phone.

FIG. 7 is a block diagram illustrating an electronic device 1000 according to an embodiment of the invention, and FIG. 8 is a diagram illustrating an embodiment in which the electronic device 1000 of FIG. 7 is implemented as a smart phone.

Referring to FIGS. 7 and 8, an embodiment of the electronic device 1000 may include a processor 1010, a memory device 1020, a storage device 1030, an input/output ("I/O") device 1040, a power supply 1050, and a display device 1060. In such an embodiment, the display device 1060 may be the display device 10 of FIG. 1. In an embodiment, the electronic device 1000 may further include a plurality of ports for communicating with a video card, a sound card, a memory card, a universal serial bus ("USB") device, other electronic device, and the like. In an embodiment, as illustrated in FIG. 8, the electronic device 1000 may be implemented as a smart phone. However, the electronic device 1000 is not limited thereto. In one alternative embodiment, for example, the electronic device 1000 may be implemented as a cellular phone, a video phone, a smart pad, a smart watch, a tablet personal computer ("PC"), a car navigation system, a computer monitor, a laptop, a head mounted display ("HMD") device, and the like.

The processor 1010 may perform various computing functions. The processor 1010 may be a micro processor, a central processing unit ("CPU"), an application processor ("AP"), or the like. The processor 1010 may be connected to other components via an address bus, a control bus, a data bus, or the like. In an embodiment, the processor 1010 may be connected to an extended bus such as a peripheral component interconnection ("PCI") bus. The memory device 1020 may store data for operations of the electronic device 1000. In one embodiment, for example, the memory device 1020 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, and the like and/or at least one volatile memory device such as a dynamic random access memory ("DRAM") device, a static random access memory ("SRAM") device, a mobile DRAM device, and the like. The storage device 1030 may include a solid state drive ("SSD") device, a hard disk drive ("HDD") device, a CD-ROM device, or the like. The I/O device 1040 may include an input device such as a keyboard, a keypad, a mouse device, a touch-pad, a touch-screen, and the like, and an output device such as a printer, a speaker, and the like. In an embodiment, the I/O device 1040 may be included in the display device 1060. The power supply 1050 may provide power for operations of the electronic device 1000.

The display device 1060 may display an image corresponding to visual information of the electronic device 1000. In such an embodiment, the display device 1060 may include a display panel including a first display region where first pixels having a first size are disposed, and a second display region surrounding the first display region, in which second pixels having a second size different from the first size are disposed in the second display region, a gate driver which applies a gate signal to a gate line of the display panel, a data driver which applies a data voltage to a data line of the display panel, and a timing controller which controls the gate driver and the data driver. In such an embodiment, the gate line may include a first gate line connected to both the first pixel and the second pixel, and a second gate line connected only to the second pixel. In such an embodiment, the data line may include a first data line that does not transmit the data voltage to the second pixel connected to the second gate line, and a second data line that transmits the data voltage to the second pixel connected to the second gate line. In such an embodiment, a dummy data voltage may be applied to the first data line when the gate signal is applied to the second gate line. In such an embodiment, the display device 1060 may reduce the coupling phenomenon between data voltages and prevent the vertical crosstalk phenomenon caused by the electrical interference. As a result, the display device 1060 may improve the reliability of display quality by minimizing defects in image quality of an image displayed on the display panel. For convenience of description, any repetitive detailed description of the same or like elements of the display device 1060 as those described above will be omitted.

Embodiments of the invention may be applied to any display device and an electronic device including the display device. In one embodiment, for example, the invention may be applied to a digital television ("TV"), a three-dimensional ("3D") TV, a mobile phone, a smart phone, a tablet computer, a virtual reality ("VR") device, a PC, a home electronic device, a notebook computer, a personal digital assistant ("PDA"), a portable media player ("PMP"), a digital camera, a music player, a portable game console, a navigation, etc.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel including a first display region, and a second display region surrounding the first display region, wherein a first pixel having a first size is disposed in the first display region, and a second pixel having a second size different from the first size is disposed in the second display region;

a gate driver which applies a gate signal to a gate line of the display panel;

a data driver which applies a data voltage to a data line of the display panel; and a timing controller which controls the gate driver and the data driver, wherein the gate line includes a first gate line connected to both the first pixel and the second pixel, and a second gate line connected only to the second pixel, the data line includes a first data line which does not transmit the data voltage to the second pixel connected to the second gate line, and a second data line which transmits the data voltage to the second pixel connected to the second gate line, and a dummy data voltage is applied to the first data line when the gate signal is applied to the second gate line.

2. The display device of claim 1, further comprising:

a data corrector which generates correction data based on input image data and a lookup table.

3. The display device of claim 2, wherein the data corrector includes:

a display region determiner which identifies first image data to be displayed on the first display region and second image data to be displayed on the second display region based on the input image data;

the lookup table in which an arrangement information of the first gate line and the second gate line is stored; and a correction data generator which generates the correction data by using the lookup table.

4. The display device of claim 3, wherein the timing controller receives the correction data from the data corrector and generates a dummy data signal based on the correction data.

5. The display device of claim 4, wherein the data driver applies the dummy data voltage, which is generated based on the dummy data signal, to the first data line when the gate signal is applied to the second gate line.

6. The display device of claim 1, wherein the second data line is provided in plural, and the dummy data voltage is identical to a data voltage applied to a second data line closest to the first data line.

7. The display device of claim 1, wherein the dummy data voltage is identical to the data voltage applied to the first data line in a previous frame.

8. The display device of claim 1, wherein the dummy data voltage has a voltage level corresponding to an intermediate value of the data voltage applied to the second data line.

9. The display device of claim 1, wherein the dummy data voltage has a voltage level between a voltage level of the data voltage corresponding to a black image and a voltage level of the data voltage corresponding to a white image.

10. The display device of claim 1, wherein the second display region includes a corner display region extending from a corner of the second display region, and a middle display region between the first display region and the corner display region.

11. A method of driving a display device, the method comprising:

applying a gate signal to a first gate line connected to both a first pixel and a second pixel;

applying the gate signal to a second gate line connected only to the second pixel; and applying a data voltage to a data line, wherein the first pixel has a first size and is disposed in a first display region, the second pixel has a second size different from the first size and is disposed in a second display region surrounding the first display region, the data line includes a first data line which does not transmit the data voltage to the second pixel connected to the second gate line, and a second data line which transmits the data voltage to the second pixel connected to the second gate line, and the applying the data voltage to the data line includes applying a dummy data voltage to the first data line when the gate signal is applied to the second gate line.

12. The method of claim 11, further comprising:

generating correction data based on input image data and a lookup table.

13. The method of claim 12, wherein the generating the correction data includes:

identifying first image data to be displayed on the first display region and second image data to be displayed on the second display region based on the input image data; and generating the correction data by using a lookup table in which arrangement information of the first gate line and the second gate line is stored.

14. The method of claim 13, further comprising:

generating a dummy data signal based on the correction data.

15. The method of claim 14, wherein the applying the data voltage to the data line further includes:

generating the dummy data voltage based on the dummy data signal.

16. The method of claim 11, wherein the second data line is provided in plural, and the dummy data voltage is identical to a data voltage applied to a second data line closest to the first data line.

17. The method of claim 11, wherein the dummy data voltage is identical to the data voltage applied to the first data line in a previous frame.

18. The method of claim 11, wherein the dummy data voltage has a voltage level corresponding to an intermediate value of the data voltage applied to the second data line.

19. The method of claim 11, wherein the dummy data voltage has a voltage level between a voltage level of the data voltage corresponding to a black image and a voltage level of the data voltage corresponding to a white image.

20. The method of claim 11, wherein the second display region includes a corner display region extending from a corner of the second display region, and a middle display region between the first display region and the corner display region.

* * * * *